US009155358B2

(12) United States Patent
Zigmans

(10) Patent No.: US 9,155,358 B2
(45) **Date of Patent: *Oct. 13, 2015**

(54) CONTAINER FOR A SUBSTANCE TO BE SPRAYED

(71) Applicant: S.C. Johnson & Son, Inc., Racine, WI (US)

(72) Inventor: Johannes Antonius G. W. Zigmans, Utrecht (NL)

(73) Assignee: S.C. Johnson & Son, Inc., Racine, WI (US)

( * ) Notice: Subject to any disclaimer, the term of this patent is extended or adjusted under 35 U.S.C. 154(b) by 86 days.

This patent is subject to a terminal disclaimer.

(21) Appl. No.: 14/085,539

(22) Filed: Nov. 20, 2013

(65) Prior Publication Data

US 2014/0077001 A1 Mar. 20, 2014

Related U.S. Application Data

(60) Continuation of application No. 13/469,360, filed on May 11, 2012, now Pat. No. 8,616,472, which is a continuation of application No. 12/938,157, filed on Nov. 2, 2010, now Pat. No. 8,272,581, which is a (Continued)

(30) Foreign Application Priority Data

Apr. 22, 2002 (EP) ..... 02076601

(51) Int. Cl.
*A62C 2/08* (2006.01)
*A43D 3/14* (2006.01)

(Continued)

(52) U.S. Cl.
CPC ..... *A43D 3/1491* (2013.01); *B65D 83/206* (2013.01); *B65D 83/30* (2013.01); *B65D 83/40* (2013.01); *B65D 83/753* (2013.01)

(58) Field of Classification Search
CPC .... B05B 7/24; B05B 7/2405; B05B 11/3001; B05B 11/3004; B05B 11/3012
USPC ..... 239/302, 333, 337, 338, 345, 373, 239/553.5, 548; 222/162, 185.1, 394, 497, 222/173, 184
See application file for complete search history.

(56) References Cited

U.S. PATENT DOCUMENTS 1,837,339 A 12/1931 Schlick
1,851,588 A 3/1932 Nelson (Continued)

FOREIGN PATENT DOCUMENTS

CN 2443777 8/2001
DE 4304284 8/1994

(Continued)

OTHER PUBLICATIONS

Das Nachschlagewerk für Junggesellen, frag-Mutti.de, http://www.frag-mutti.de/tipp/p/show/category_ID/5/article_ID/911/Penatencreme-gegen-Schweissfuesse.html, Apr. 11, 2007.

(Continued)

*Primary Examiner* — Davis Hwu

(57) ABSTRACT

A container for a substance to be sprayed includes a reservoir for the substance and operable spraying means connected to the reservoir for spraying the substance. The spraying means are provided with at least two spaced apart outflow openings that are in fluid communication with the reservoir for spraying the substance in at least two spray beams to surroundings.

17 Claims, 7 Drawing Sheets

Related U.S. Application Data continuation of application No. 12/024,433, filed on Feb. 1, 2008, now Pat. No. 7,909,268, which is a division of application No. 10/971,893, filed on Oct. 22, 2004, now abandoned, which is a continuation of application No. PCT/NL03/00291, filed on Apr. 17, 2003.

(51) Int. Cl.

| | |
|---|---|
| ***B65D 83/20*** | (2006.01) |
| ***B65D 83/30*** | (2006.01) |
| ***B65D 83/40*** | (2006.01) |
| ***B65D 83/14*** | (2006.01) |

(56) References Cited

U.S. PATENT DOCUMENTS

| | | | | |
|---|---|---|---|---|
| 1,919,027 | A | 7/1933 | Klotzman | |
| 2,767,023 | A | 10/1956 | Venus, Jr. | |
| 3,129,893 | A | 4/1964 | Green | |
| 3,174,692 | A | 3/1965 | Green | |
| 3,246,850 | A | 4/1966 | Bourke | |
| 3,504,862 | A | 4/1970 | Lowry | |
| 3,519,210 | A | 7/1970 | Du Plain | |
| 3,628,733 | A | 12/1971 | Kahn | |
| 3,785,571 | A | 1/1974 | Hoening | |
| 4,226,340 | A | 10/1980 | Troesch | |
| 4,247,049 | A | 1/1981 | Gailitis | |
| 4,272,019 | A | 6/1981 | Halaby, Jr. | |
| 4,717,074 | A | 1/1988 | Karliner et al. | |
| 5,735,465 | A | 4/1998 | De Laforcade | |
| 5,785,250 | A | 7/1998 | De Laforcade | |
| 6,036,113 | A | 3/2000 | D'Angelo | |
| 6,149,077 | A | 11/2000 | Pohler | |
| 6,439,435 | B2 | 8/2002 | Rosenberg | |
| 6,726,130 | B2 | 4/2004 | Jaubertie | |
| 6,824,077 | B2 | 11/2004 | De Laforcade | |
| 7,909,268 | B2 | 3/2011 | Zigmans | |
| 8,272,581 | B2 | 9/2012 | Zigmans | |
| 8,616,472 | B2 * | 12/2013 | Zigmans | 239/548 |
| 2001/0050292 | A1 | 12/2001 | Rosenberg | |

FOREIGN PATENT DOCUMENTS

| | | |
|---|---|---|
| EP | 0 430 946 | 6/1994 |
| EP | 0 734 969 | 6/1997 |
| EP | 0 755 878 | 9/2004 |
| EP | 1 277 516 | 1/2007 |
| FR | 1379192 | 11/1964 |
| FR | 2737198 | 1/1997 |
| JP | 06-320060 | 11/1994 |
| JP | 09-154848 | 6/1997 |
| JP | 2000-256101 | 9/2000 |
| NZ | 236776 | 2/1992 |
| NZ | 233906 | 4/1992 |
| RU | 2093276 | 10/1997 |

OTHER PUBLICATIONS

Shay et al., Atomization of Liquids With Mechanical Breakup Actuators, Aerosol Age, Dec. 1975, 5 pages.

Ausdruck Agruf vom Apr. 15, 2008, Document cited in Opposition for European Patent No. 1357057 on May 21, 2008.

Office Action for European Application No. EP02076601, date of mailing Jan. 4, 2005, 3 pages.

Office Action for European Application No. EP02076601, date of mailing Jun. 29, 2004, 6 pages.

Office Action for European Application No. EP02076601, date of mailing Jan. 20, 2006, 5 pages.

Office Action for European Application No. EP02076601, date of mailing Apr. 3, 2007, 1 page.

Office Action for European Application No. EP02076601, date of mailing May 24, 2007, 2 pages.

European Search Report for European Application No. EP02076601, date of mailing Oct. 7, 2002, 3 pages.

* cited by examiner

CONTAINER FOR A SUBSTANCE TO BE SPRAYED

CROSS-REFERENCE TO RELATED PATENT APPLICATIONS

This application is a Continuation of U.S. patent application Ser. No. 13/469,360, filed May 11, 2012, which is a Continuation of U.S. patent application Ser. No. 12/938,157, filed Nov. 2, 2010, which is a Continuation of U.S. patent application Ser. No. 12/024,433, filed Feb. 1, 2008, which is a Divisional of U.S. patent application Ser. No. 10/971,893, filed Oct. 22, 2004, which is a Continuation of International Application No. PCT/NL03/00291, filed Apr. 17, 2003, which claims the benefit of priority of European Patent Application 02076601.0, filed Apr. 22, 2002, all of which are incorporated herein by reference in their entireties.

BACKGROUND

The invention relates to a container for a substance to be sprayed, wherein the container comprises a reservoir for the substance, the container being provided with operable spray means connected to the container for spraying the substance.

Such a container is known from Japanese patent application JP 256101A and comprises an aerosol with a reservoir for a pressurized substance to be sprayed into a shoe. The aerosol is provided with an outflow channel with a spray head, connected to the reservoir. During use, the substance is sprayed as a spray from the reservoir and the outflow channel via an outflow opening of the spray head into the shoe. The substance can, for instance, effect a disinfectant and/or antibacterial action in the shoe. It is noted that the term spraying is to be understood in a broad sense and may also involve terms such as sprinkling, atomizing, misting and the like.

A drawback of the known container is that the spray sprayed therewith, in particular into the shoe, has a relatively small spray range. As a consequence, during use, only a small part of the inside of the shoe can be sprayed by the container, while a relative large part of the inner space of the shoe remains unsprayed. This has as a result that the contemplated effects of the use of the container are relatively limited. Moreover, with the known container, spraying has to take place over a relatively long period of time so as to bring the desired amount of the substance in an area to be sprayed, for instance in the shoe. Another drawback of the known container is that the spraying means, during use, are relatively difficult to aim for spraying the substance in the desired direction in the surroundings. Consequently, the spray often does not reach a part of those surroundings to be treated by the spray.

The invention contemplates obviating the drawbacks of the container while maintaining its advantages. In particular, the invention contemplates a container with which a relatively large area can be sprayed.

To this end, the container according to the invention is characterized in that the spraying means are provided with at least two spaced apart outflow openings which can be brought into fluid communication with the container for spraying the substance in at least two spray beams to the surroundings.

SUMMARY

During use of this container, at least two spray beams are generated to be sprayed into the surroundings Consequently, during one operation of the spraying means a relatively large part of those surroundings can be covered at one time with the spray, for instance for treating those surroundings and/or a boundary of those surroundings. Furthermore, the at least two spray beams can often be aimed in a relatively simple manner because the beams come from openings arranged at a distance from each other, at least when one of the beams is visible, as the direction of the visible beam is often a good indication for the direction of each of the other beams.

Preferably, the reservoir of the container is filled with a substance for treating an inside of a shoe, so that the container can be used in a simple manner to spray the substance into a shoe for treating the inside of that shoe. Then, a large part of the inside of the shoe can be treated relatively rapidly.

The outflow openings can be arranged relative to each other in different manners. For instance, the outflow openings can be arranged relative to each other such, that the respective spray beams have, on average, a substantially similar spraying direction. This has the advantage that thus, a relatively broad spray front of the spray can be formed, so that a relatively large space, located opposite the outflow openings mentioned, can be provided with the substance at one time. Further, the outflow openings can be arranged. relative to each other such, that the respective spray beams have substantially different spraying directions, so that different areas can be sprayed simultaneously. The outflow openings can for instance be arranged relatively to each other such, that the respective spray beams have substantially opposite spraying directions. As a result, for instance when using the container for spraying the substance into a shoe, both a heel part and a toe area of the shoe can be sprayed in one operation of the spraying means, at least when the outflow openings are aimed at those shoe parts.

According to a further elaboration of the invention, each outflow opening is arranged to generate a spray beam from substance flowing, during use, from the reservoir via the fluid communication mentioned to that outflow opening Thus, during operation of the spraying means, the substance present in the reservoir can flow to each outflow opening and then be converted by that outflow opening into a spray to be sprayed as a spray beam in a desired area. In this manner, the outflow openings can be arranged relatively far from each other so that relatively many outflow openings in the spraying means can be used. The use of relatively many outflow openings, in particular three or more, has the particular advantage that consequently, a relatively large spraying range is obtained. In this manner, further, a relatively large amount of the substance mentioned can relatively rapidly be brought into the area to be sprayed in the form of a spray. The fluid communication mentioned can for instance be provided with branches extending towards the outflow openings mentioned.

According to an alternative elaboration of the invention, the fluid communication mentioned is provided with spray-forming means for generating a spray from substance flowing, during use, from the reservoir via the communication to the at least two outflow openings.

As a result, the container can, for instance, keep functioning properly when the pressure in at least the reservoir of the container is relatively low because the spray-forming means are already positioned in or near the fluid communication mentioned. The spray-forming means can for instance comprise a spray nozzle, a fluid atomizer, a mist sprayer or the like arranged in or near the fluid communication. The spray generated by these means is carried, during use, to the at least two spaced apart outflow openings, to be distributed in a spray area in at least two associated spray beams. Preferably, the fluid communication mentioned is provided with a collecting chamber for collecting the spray generated by the spray-forming means, while the collecting chamber is provided with the outflow openings mentioned for spraying the spray, collected in the chamber, in the at least two spray beams to surroundings. The collecting chamber can collect the generated spray in a simple manner and distribute it via the outflow openings over a large area.

According to a particularly advantageous embodiment of the invention, the spraying means are provided with support means for placing the container during use substantially stably on a support surface, in particular on an inside of the shoe.

With these support means, aiming the at least two spray beams is considerably simplified. Moreover, the support means can provide strength to the spraying means, which enhances the life span of the spraying means. It is highly advantageous when the spraying means are provided with a movable operating part, while the fluid communication mentioned with the operating part in a first and second operating position, respectively, is closed off and opened, respectively, while the operating part is arranged to be brought from the first to the second position by, during use, pushing the container by the support means against the support surface mentioned. In this manner, operating the spraying means can be done in a simple manner utilizing the support means, so that a user of the container then only needs to push the container by the support means against the support surface. The spraying means can be provided with spring means arranged to exert a spring force on the operating part mentioned of the spraying means such, that the operating part is moved, in a simple manner, under the influence of that force, from the second to the first operating position, without the user, after having operated the container, having to carry out special operations other than moving the support means from the support surface.

According to a highly advantageous elaboration of the invention, at least a part of the spraying means forms a cap which is provided with each outflow opening mentioned.

The cap can protect at least a part of the container from damage, for instance as a consequence of disadvantageous influences of the surroundings, such as unforeseen mechanical forces. Moreover, the cap comprises the outflow openings mentioned, so that the container can be designed with relatively few parts. Furthermore, the cap can form an esthetic embellishment of the container.

The invention further provides a cap, evidently destined for a container according to claim 18. This cap offers the container the abovementioned advantages. The cap can be detachably connected to the container, so that the cap can be easily replaced with a different cap. When, for instance, the container is filled with a substance for treating shoes, this is advantageous when a different type of shoe is to be treated with the container, the other cap, with outflow openings arranged in a different manner relative to each other, yielding a better spraying result. The cap can further be arranged, in a simple manner, to be connected to commercially available standard containers such as standard aerosols, to give these containers the advantages of the present invention. To that end, the cap can be designed to engage and/or to be connected to an outflow channel of the commercially available standard container.

The invention further relates to a method for manufacturing a container for a substance to be sprayed, wherein the container comprises a reservoir for the substance, the container being provided with an operable outflow channel.

This method known from practice is characterized according to the invention in that the container is provided with a cap protecting the outflow channel, with at least two outflow openings, wherein each outflow opening of the cap is brought in fluid communication with the outflow channel mentioned of the container.

In this manner, the container is provided in a simple manner with a cap for screening the outflow channel, which cap, moreover, offers the container the above-mentioned advantages. The cap can be arranged to provide the fluid communication between the outflow openings and the outflow channel of the container. Further, for instance, fluid communication parts such as fluid tubes or the like can be fitted between the outflow opening of the cap and the outflow channel of the container during assembly of the container.

DETAILED DESCRIPTION OF EXEMPLARY EMBODIMENTS

Figure 2:
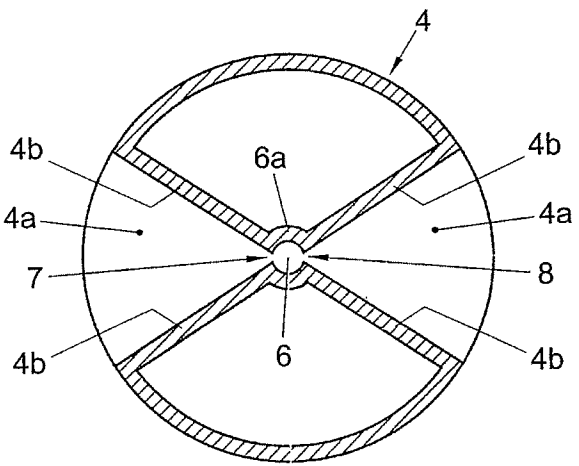
FIG. 2 shows a cross sectional view along the line II-II of the side view represented in FIG. 1.
Figure 1:
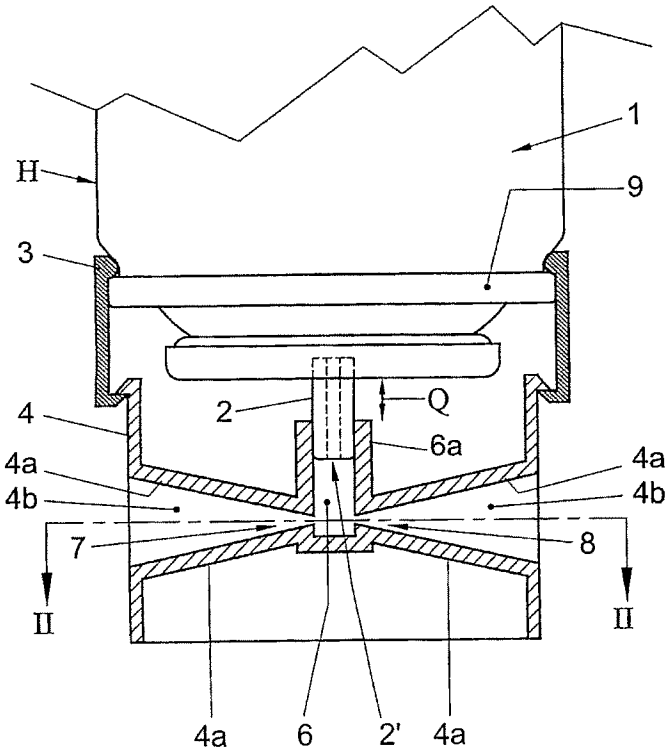
FIG. 1 shows a partly cutaway side view of a first exemplary 16 embodiment of the invention.
Figure 3:
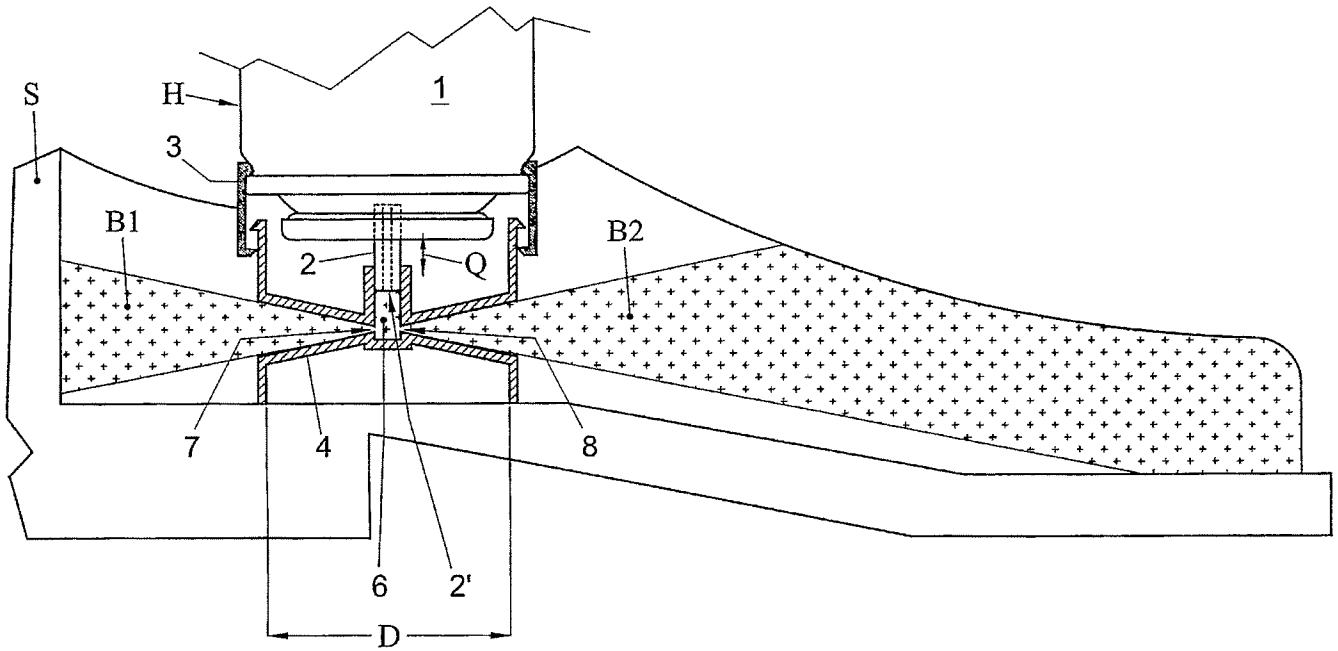
FIG. 3 shows a cutaway side view of a use of the exemplary embodiment represented in FIGS. 1 and 2.

FIGS. 1 and 2 show a first exemplary embodiment of a substantially cylinder-shaped aerosol H for a substance to be sprayed into a shoe. The aerosol H comprises a reservoir 1 of which in the side view shown in FIG. 1 an outer wall is represented. At an extremity, the aerosol H is provided with a cylindrical outflow channel 2, which is connected to the aerosol H so as to be movable in axial direction from a first to a second operating position, vice versa. In FIGS. 1 and 3, respectively, the first and second position, respectively, of the outflow channel 2 is represented. The outflow channel 2 is provided with valve means (not shown) which are arranged for closing and or keeping opened, respectively, the channel 2 at the first and second operating position, respectively.

At the extremity represented in the FIGS. 1, 2, the aerosol H is provided with a cap 3, 4 for the purpose of screening that extremity and at least a part of the outflow channel 2 extending outside the container H. The cap can prevent damage to the outflow channel 2. The cap comprises a first operating part 3 which is fixedly connected to a flange-shaped circumferential edge 9 of the aerosol H. A second operating part 4 of the cap 3, 4 is coupled to the first cap operating part 3 so as to be telescopically slidable in a direction represented with arrow Q, to the first cap operating part 3. The second operating part 4 is provided with a cylindrical spray collecting chamber 6 which is arranged downstream relative to the outflow channel 2 of the aerosol H. An extremity 2' of the outflow channel 2 facing this collecting chamber 6 is arranged for generating a spray from substance flowing during use from the reservoir 1 via the channel 2 to the collecting chamber 3. An advantage of use of one outflow channel 2 arranged for generating the spray is that the container H can still generate spray when the pressure in the container H is relatively low. A cylinder wall

6*a* of the spray collecting chamber 6 is connected to an outside of the outflow channel 2, for instance by way of a glue connection. Further, the wall 6*a* of the spray collecting chamber 6 is provided with two outflow openings 7, 8 arranged opposite each other. The movable operating part 4 of the cap 3, 4 is further provided with diverging walls 4*a*, 4*b* extending from the edges of each outflow opening 7, 8 in downstream direction. During use, these wails 4*a*, 4*b* can bundle spray coming from the collecting chamber 6.

FIG. 3 shows the use of the first exemplary embodiment. Here, the substance present in the aerosol has been pressurized. As shown in FIG. 3, the aerosol H is pushed by a user by the operating part 4 of the cap 3, 4 serving as a support onto the inside of a shoe S serving as a support surface. Under the influence of the forces exerted by the user and the shoe S on the movable operating part 4, this operating part 4 is moved in axial direction Q from a first to a second operating position, so that the outflow channel 2 is brought to the second operating position. As a result, the outflow channel 2 is opened so that substance, present in the aerosol flows via this channel 2 to the spray collecting chamber 6. The outflow channel 2 thereby forms a spray of the substance, which spray is represented in the Figure with +-symbols. The collecting chamber 6 collects this spray and distributes the spray in the shoe S via the two outflow openings 7, 8 in the form of two spray beams B1, B2. The spray beams B1, B2 have opposite outflow directions, so that with the beams B1, B2, both a toe and a heel part of the inside of the shoe S can be sprayed. As, during use, the aerosol H is placed by the cap 3, 4 on the shoe S in a stable manner, pressing in the outflow channel 2 can be done in a simple manner while the beams B1, B2 can be accurately aimed at the inside of the shoe.

Preferably, a supporting edge of the second operating part 4 touching the shoe S during use, has a diameter D of at least 1 cm, in particular at least 2 cm, more in particular at least 3 cm, so that, during use, a good support can be obtained. As shown in the Figures, the diameter D of the support edge mentioned in the present exemplary embodiment is virtually equal to the outer diameter of the container H.

Figure 5:
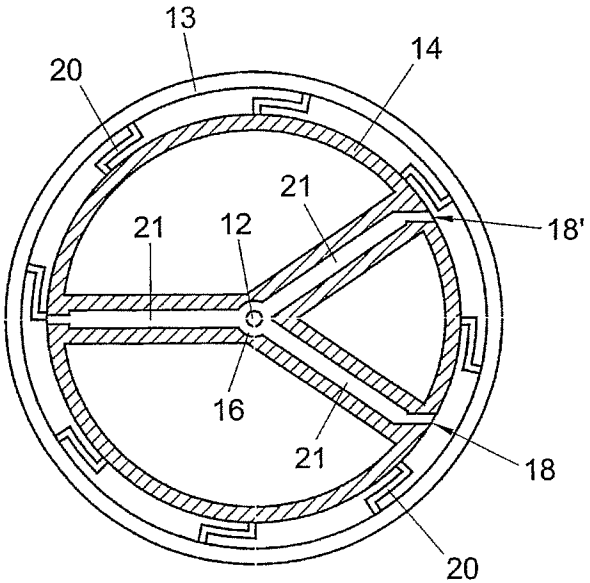
FIG. 5 shows a cross sectional view along the line V-V of the side view represented in FIG. 4.
Figure 4:
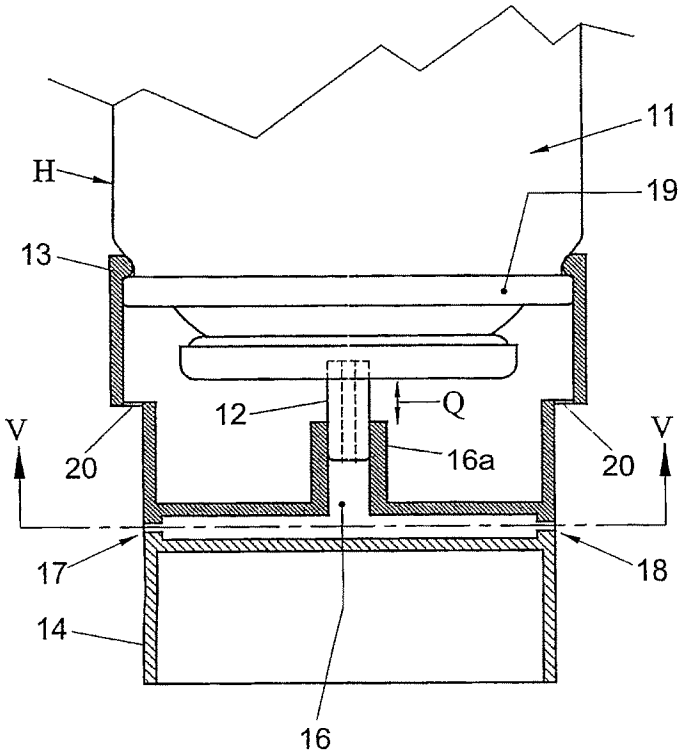
FIG. 4 shows a partly broken away side view of a second exemplary embodiment of the invention.

The second exemplary embodiment represented in FIGS. 4 and 5 differs from the first exemplary embodiment in that this second exemplary embodiment is provided with a cap 13, 14, a second movable operating part 14 of which is connected by means of elastic spring lips 20 to a first operating part fixedly connected. to an edge 19 of the aerosol H. The second operating part 14 is provided with a fluid collecting chamber 16, a cylindrical wall 16A of which is connected to the outflow channel 12 of the aerosol. Downstream relative to the outflow channel 12, the fluid collecting chamber 16 branches off in three fluid channels 21 which extend in radial direction outwardly to respective outflow openings 17, 18, 18'. Each outflow opening 17, 18, 18' is arranged to generate a spray beam from substance flowing, during use, from the reservoir 11 via that opening 17, 18, 18' to surroundings. Two of the three outflow openings 18, 18' are arranged relative to each other such, that the spray beams B12, B12' coming therefrom have, on average, a substantially similar spraying direction. The other outflow opening 17 is arranged relative to these two openings 18, 18', such, that the spray beam B11 produced by this opening has 15 a substantially opposite, different spraying direction than the two beams B12, B12' formed by those openings 18, 18'.

Figure 6:
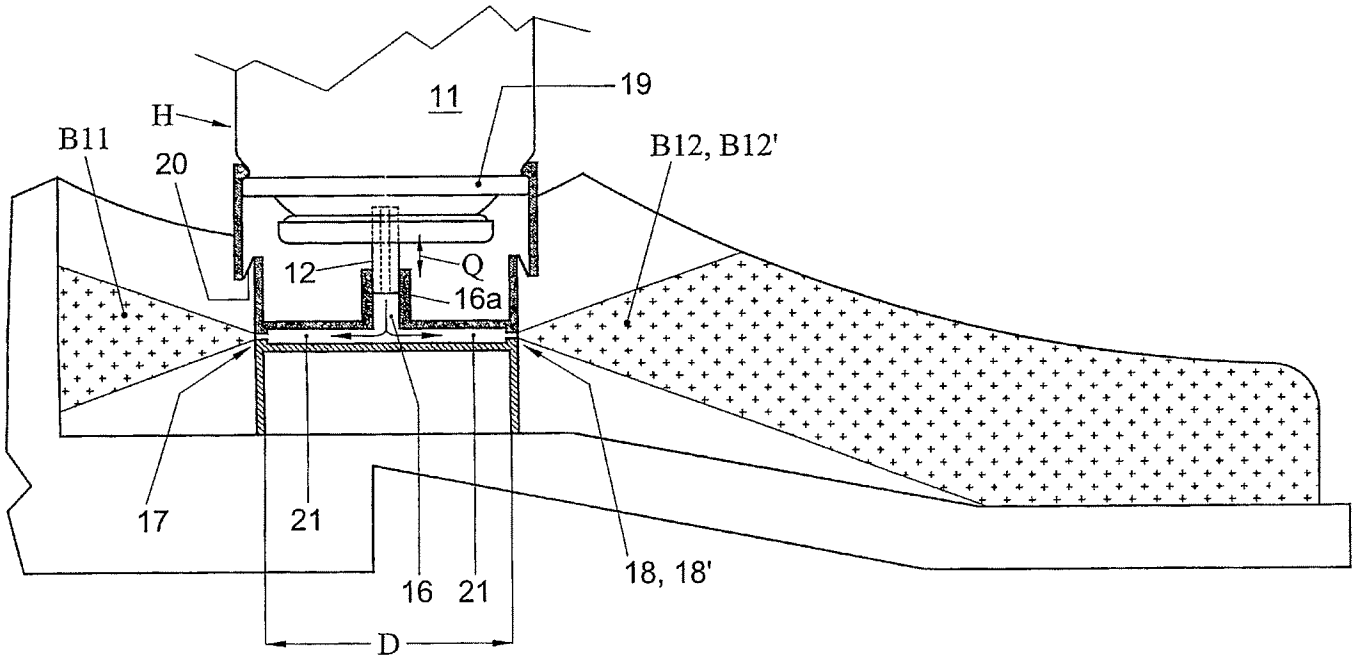
FIG. 6 shows a broken away side view of a use of the second 25 exemplary embodiment represented in FIGS. 4 and 5.

FIG. 6 shows that, during use of the second exemplary embodiment, substance flows from the reservoir 11, via the outflow channel 12, the fluid collecting chamber 16 and the three fluid channels 21 to the outflow openings 17, 18, 18' mentioned. Then, these openings 17, 18, 18' distribute the substance in the shoe S in the form of the three spray beams B11, B12, B12' mentioned. The two beams B12, B12' with substantially similar spraying direction can spray a very large part of an inner space of the nose of the shoe. At the same time, the other beam B11 can treat a heel space of the shoe S. In this second exemplary embodiment, the outflow openings 17, 18 are relatively fax apart. As a result, relatively much space is available in the second operating part 14 for providing that part 14 with outflow openings. As this second exemplary embodiment is provided with three outflow openings which are each arranged for generating the spray, with this exemplary embodiment, a relatively large amount of spray can be produced at one time and be sprayed into the shoe S. Consequently, the shoe is rapidly ready to, for instance, be worn or stored.

Figure 7:
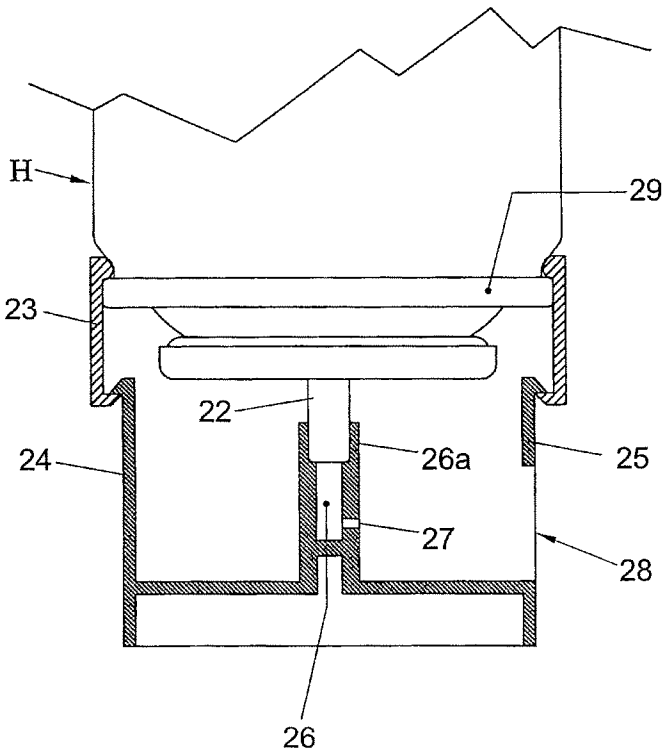
FIG. 7 shows a partly broken away side view of a third exemplary embodiment of the invention.

FIG. 7 shows a third embodiment, which is provided with a support cap 23, 24 for placing the aerosol H during use substantially stably onto a support surface during operation of spraying means of the container. The third exemplary embodiment differs from the first exemplary embodiment represented in FIGS. 1 and 2 in that the support cap 23, 24 is provided with only one outflow opening 27 which is arranged to generate one spray beam B from substance flowing, during use, from the aerosol H via the opening 27 to surroundings. Further, the movable operating part 24 of the support cap 23, 24 is not provided with diverging walls extending from edges of the outflow opening 27 in downstream direction. Instead thereof, a sidewall 25 of the moveable cap operating part 24, extending concentrically around the collecting chamber 26 is provided with an opening 28, through which the spray beam B generated by the outflow opening 27 can leave the cap to reach an area to be sprayed. Further, the collecting chamber 26 is of a somewhat reduced design relative to the diameter of the outflow channel 22, so that an axial movement of the movable cap part 24 can easily be transferred to the outflow channel 22.

Figure 8:
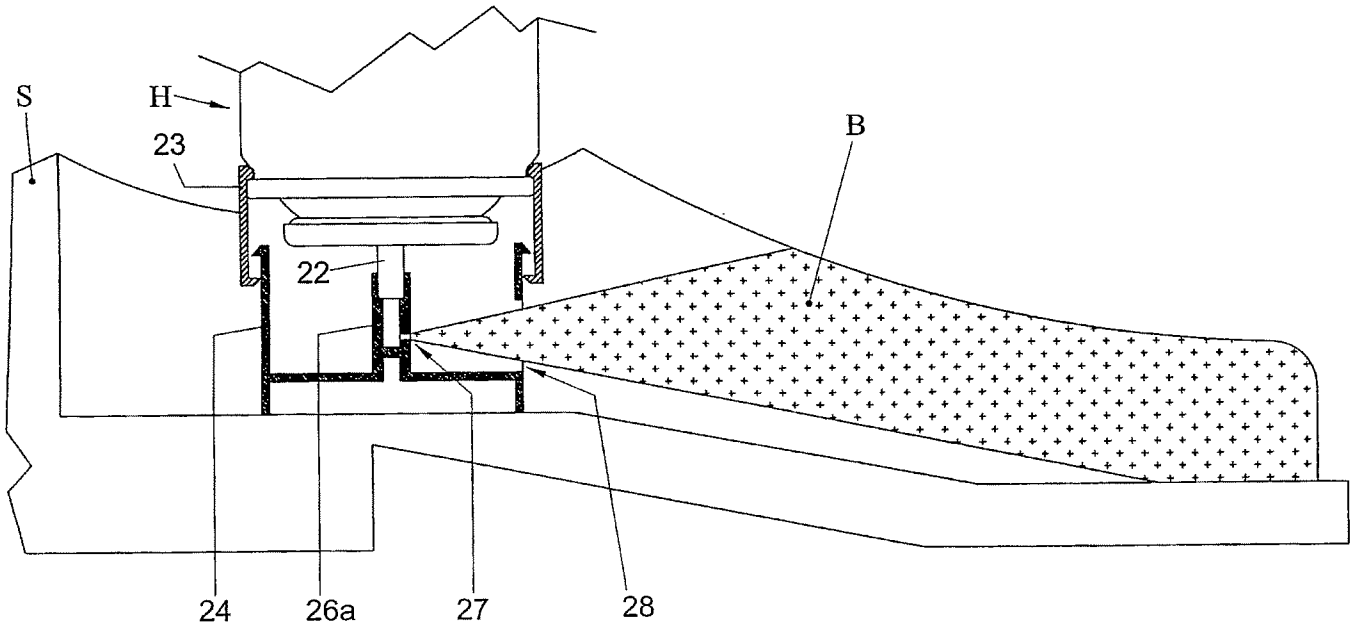
FIG. 8 shows a broken away side view of a use of the third exemplary embodiment represented in FIG. 7.

As shown in FIG. 8, with the exemplary embodiment represented in FIG. 7, the substance present in the container H can be sprayed into a shoe S in an easy manner, at least by generating the spray beam B. Operation of the spray means 23, 24 of the container H is then carried out in a manner corresponding with that of the first and second exemplary embodiment. There, the fixed cap operating part 23 effects a good guiding of the second, moveable operating part 24, so that operating the container can be done rapidly, without damage to the outflow channel 22 and/or other operating means of the container H. The relatively great diameter of the support edge of the movable cap part 24 further reduces the risk of undesired slipping of the container H during operation thereof.

Figure 9:
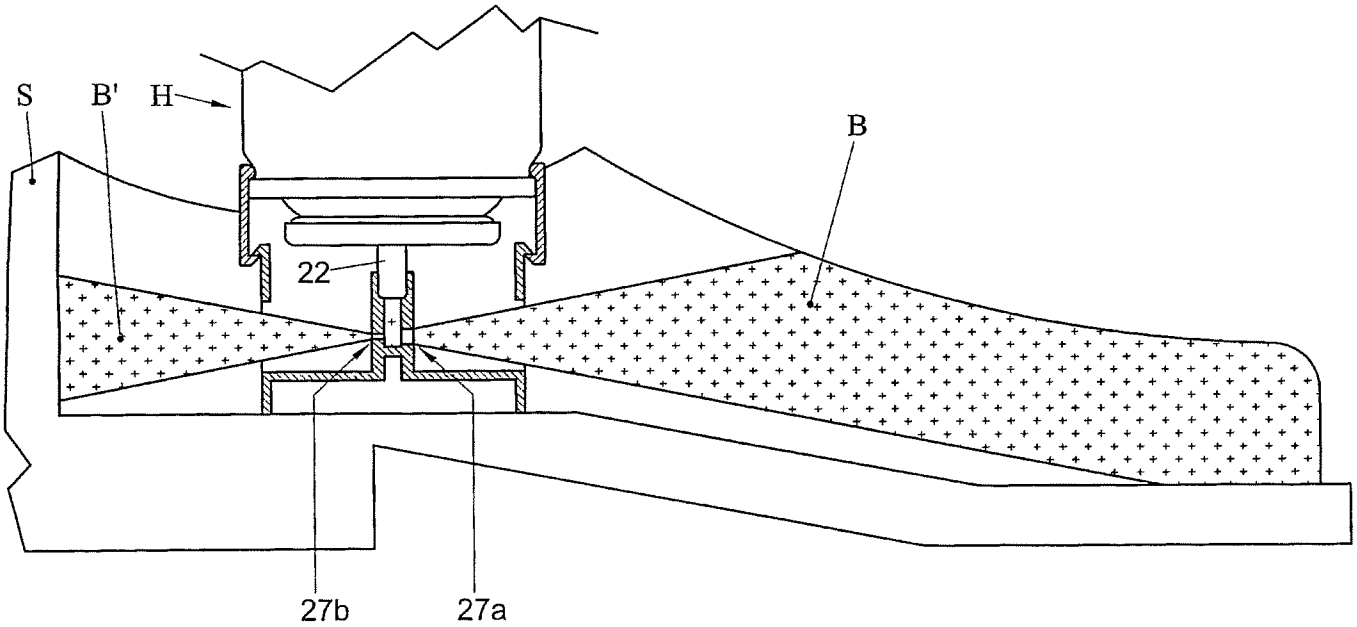
FIG. 9 shows a fourth exemplary embodiment of the invention.

The fourth exemplary embodiment, represented in FIG. 9 differs from the third exemplary embodiment in that the support cap 23, 24 is provided with two different outflow openings 27*a*, 27*b*, which are arranged to generate two spray beams B, B', respectively, from substance flowing, during use, from the aerosol H via those openings 27*a*, 27*b* to surroundings. The outflow openings 27*a*, 27*b* have different cross sections. Therefore, during use, a relatively large amount of the spray generated by the outflow channel 22 will leave the large outflow opening 27*a* in the form of the spray beam B, for instance for treating a relatively large front part of a shoe S. A further, relatively small part of the generated spray will, during use, leave the small outflow opening 27*b* via the spray beam B', for instance for the purpose of treating a heel part of the shoe S. In this manner, the generated spray can be used efficiently and be sprayed in desired amounts in desired directions.

It is evident that the invention is not limited to the exemplary embodiments described. Various modifications are possible within the framework of the invention as set forth in the following claims.

For instance, each outflow opening 7, 8, 17, 18, 27 can be formed in various manners. Each outflow opening can, for instance, have a substantially round, angular, leveled circular, oval or differently shaped cross section or a combination of these or other cross sections. Through the selection of the shape of the cross section of each outflow opening, for instance, a spray beam with a different spray image and/or spray volume can be obtained. Surprisingly, a rectangular opening whose long sides extend in vertical and horizontal direction, respectively, appears to generate a horizontal and vertical spray pattern, respectively.

Additionally, the different outflow openings 7, 8, 17, 18, 27 of each container can differ or be identical to each other in cross section and/or dimension.

Further, the spray means can be provided with spring means arranged for exerting a spring force on the movable operating part of the spray means, such, that the operating part under the influence of that force is moved back from the second to the first operating position. The spring means can, for instance, be coupled to the outflow channel of the container. Further, for instance, a movable operating part of the cap of the container can be provided with such spring means.

Additionally, the spray means of the container can be arranged for, for instance, spraying the inside of the shoe S onto which the container H is placed during use. To that end, for instance, a wall extending opposite the container outflow channel 2 of the second movable operating part 4 of the container cap can be provided with an outflow opening.

The spraying means can be provided with different means for closing off the fluid outflow communication 2, for instance valve means or the like.

Additionally, the container H can be provided with one or more outflow channels 2, 12.

Further, the spray means and/or the container H can be provided with auxiliary aiming means, for instance a marking, arrow or the like, such, that these auxiliary aiming means can facilitate aiming the container H during use. To that end, the auxiliary aiming means can, for instance, indicate a position of at least one of the outflow openings.

The substance to be sprayed into the shoe S can for instance comprise a propellant for pressurizing the substance and/or keeping it pressurized. Further, the substance can, for instance, contain certain chemical substances, in particular a deodorant, a powder, for instance talcum powder, disinfectants, odorants or the like, to effect a bactericidal and/or fungicidal, moisture regulating and/or perfuming action in the shoe. Such substances may, for instance, be destined to be sprayed before use onto an inside of the shoe, so that the substances can effect a desired action to the shoe and/or a foot wearing the shoe. Also, the substance may be sprayed into the shoe after use, for instance, to suppress unpleasant sweaty feet odors and/or have an inner sole of the shoe dry rapidly.

The container H can further be used to treat different types of shoes, for instance work shoes, leisure shoes, trainers, boots, slippers, skate-shoes, clogs or different types of footwear.

Further, the operation of the spray means may take place with or without the use of the support means mentioned serving for placing the container H during use substantially stably on an inner side of the shoe S. The spray means can for instance be provided with an operating mechanism with which a user can effect the fluid communication mentioned between the reservoir 1 and the outflow openings 7, 8 by hand and independently of the position of the container H relative to the shoe S.

Further, the container can be destined for spraying different types of substances in different spaces. The container may for instance contain an insecticide for fighting vermin, an air freshener for freshening air or the like.

When the spraying means comprise a cap which is provided with a first cap operating part connected to the container, to which part a second cap operating part is movably coupled, the first and/or the second cap operating part can be provided with one or more outflow openings which can be brought into fluid communication with the contents of the container reservoir.

Additionally, the container can, for instance, be manufactured in a simple manner, in that the container H is provided with a cap 3, 4; 13, 14; 23, 24 screening the outflow channel 2; 12; 22, which cap is provided with a fixed operating part 3; 13; 23 which is coupled to the container H, while the cap is provided with a movable operating part 4; 14; 24, which is coupled to the fixed operating part 3; 13; 23 so as to be guidable from a first to a second position, vice versa.

What is claimed is:

1. An apparatus for spraying a substance into an interior area of a shoe, the apparatus comprising:

a container providing a reservoir for the substance and an outlet channel;

a sprayer coupled to the container and having:

a spray former;

at least one outflow opening in a first horizontal direction that can be brought into fluid communication with the reservoir for generating a first spray pattern; and at least one outflow opening in a second horizontal direction that can be brought into fluid communication with the reservoir for generating a second spray pattern;

a pair of guidewalls extending outward from the at least one outflow opening in the first horizontal direction and the at least one outflow opening in the second horizontal direction;

wherein the at least one outflow opening in the first horizontal direction and the at least one outflow opening in the second horizontal direction are spaced apart from each other so that the first and second spray patterns are in substantially opposite horizontal spraying directions; and wherein the at least one outflow opening in the first horizontal direction and the at least one outflow opening in the second horizontal direction differ from each other in at least one of a cross section and a dimension in order to create different spray patterns in the substantially opposite spray directions;

wherein a cross-sectional area between the pair of guidewalls increases as the guidewalls extend outward from the at least one outflow opening.

2. The apparatus of claim 1, wherein the sprayer further comprises a collecting chamber, wherein the spray former is configured to generate a spray of the substance flowing from the reservoir to the collecting chamber, and wherein the collecting chamber is configured to collect the spray generated by the spray former and distribute the spray to the first and second outflow openings.

3. The apparatus of claim 1, wherein the first and second spray patterns are generated simultaneously.

4. The apparatus of claim 1, wherein a first portion of the sprayer is coupled to the container and a second portion of the sprayer is coupled to the outlet channel and telescopically slidably coupled to the first portion, wherein the second portion telescopically slides relative to the first portion to allow the substance to flow from the reservoir to the spray former, and wherein axial depression of the second portion causes the second portion to slide into the first portion.

5. The apparatus of claim 4, wherein the second portion of the sprayer is coupled to the outlet channel and telescopically slidably coupled to the first portion such that axial depression of the second portion causes the outlet channel to move relative to the reservoir, bringing the at least one outflow opening in the first horizontal direction into fluid communication with the reservoir for generating the first spray pattern, and bringing the at least one outflow opening in the second horizontal direction into fluid communication with the reservoir for generating the second spray pattern.

6. The apparatus of claim 5, wherein the first portion of the sprayer is coupled to a circumferential edge of the container.

7. The apparatus of claim 1, wherein the at least one outflow opening in the first horizontal direction and the at least one outflow opening in the second horizontal direction each comprise only one outflow opening.

8. The apparatus of claim 1, wherein the spray former comprises at least one of a spray nozzle, a fluid atomizer, and a mist sprayer.

9. An apparatus for spraying a substance into an interior area of a shoe, the apparatus comprising:

a container providing a reservoir for the substance and an outlet channel;

a sprayer coupled to the container and having:

a spray former;

only one first outflow opening in a first substantially horizontal direction that can be brought into fluid communication with the reservoir for generating a first spray beam; and only one second outflow opening in a second substantially horizontal direction that can be brought into fluid communication with the reservoir for generating a second spray beam, the second substantially horizontal direction being substantially opposite the first substantially horizontal direction;

a plurality of guidewalls extending outward from the first and second outflow openings;

wherein the first outflow opening and the second outflow opening differ from each other in at least one of a cross section and a dimension;

wherein the plurality of guidewalls comprises a first guidewall and a second guidewall extending outward from the first outflow opening, the first and second guidewalls diverging from each other as they extend from the first outflow opening.

10. The apparatus of claim 9, wherein the spray former comprises at least one of a spray nozzle, a fluid atomizer, and a mist sprayer.

11. The apparatus of claim 9, wherein a first portion of the sprayer is coupled to a circumferential edge of the container and a second portion of the sprayer is coupled to the outlet channel and telescopically slidably coupled to the first portion, and wherein the second portion telescopically slides relative to the first portion such that axial depression of the second portion causes the outlet channel to move relative to the reservoir to allow the substance to flow from the reservoir to the spray former and such that the second portion of the sprayer slides within the first portion of the sprayer.

12. The apparatus of claim 11, wherein the second portion of the sprayer is coupled to the outlet channel and telescopically slidably coupled to the first portion such that axial depression of the second portion causes the outlet channel to move relative to the reservoir, bringing the first outflow opening into fluid communication with the reservoir for spraying the substance in the first spray beam, and bringing the second outflow opening into fluid communication with the reservoir for spraying the substance in the second spray beam.

13. The apparatus of claim 9, wherein the plurality of guidewalls comprises a third guidewall extending outward from the first outflow opening.

14. The apparatus of claim 9, wherein the plurality of guidewalls comprises a third guidewall and a fourth guidewall extending outward from the second outflow opening, the third and fourth guidewalls diverging from each other as they extend from the second outflow opening.

15. The apparatus of claim 9, wherein the first outflow opening and the second outflow opening constitute the only two outflow openings comprised by the sprayer.

16. The apparatus of claim 9, wherein a cross-sectional area between the plurality of guidewalls increases as the plurality of guidewalls extend outward from the first and second outflow openings.

17. An apparatus for spraying a substance into an interior area of a shoe, the apparatus comprising:

a container having:

a reservoir for the substance; and an outlet channel; and a sprayer having:

a spray former;

a first operating part fixed to the reservoir;

a second operating part coupled to the outlet channel and slidably coupled to an inner surface of the first operating part, the second operating part including a first portion defining:

a first outflow opening having a relatively large cross-section and configured to provide, when the apparatus is operated, a relatively large amount of spray in a first direction; and a second outflow opening having a relatively small cross-section and configured to provide, when the apparatus is operated, a relatively small amount of spray in a second direction opposite the first direction;

a first set of at least three guidewalls that diverge from one another as they extend downstream from the first outflow opening; and a second set of at least three guidewalls that diverge from one another as they extend downstream from the second outflow opening.

* * * * *